US010145106B2

(12) United States Patent
Abeel et al.

(10) Patent No.: US 10,145,106 B2
(45) Date of Patent: Dec. 4, 2018

(54) SLAT ROOF AND METHOD FOR ADAPTING A SLAT ROOF

(71) Applicant: RENSON SUNPROTECTION-SCREENS NV, Waregem (BE)

(72) Inventors: Bart Pieter Jules Abeel, Sint-Eloois-Winkel (BE); Kristof Lemiegre, Gentbrugge (BE)

(73) Assignee: RENSON SUNPROTECTION-SCREENS NV, Waregem (BE)

( * ) Notice: Subject to any disclaimer, the term of this patent is extended or adjusted under 35 U.S.C. 154(b) by 0 days.

(21) Appl. No.: 15/537,872

(22) PCT Filed: Mar. 10, 2017

(86) PCT No.: PCT/IB2017/051412
§ 371 (c)(1),
(2) Date: Jun. 19, 2017

(87) PCT Pub. No.: WO2017/199105
PCT Pub. Date: Nov. 23, 2017

(65) Prior Publication Data

US 2018/0202155 A1 Jul. 19, 2018

(30) Foreign Application Priority Data

May 19, 2016 (BE) ..... 2016/5365

(51) Int. Cl.
*E04B 7/16* (2006.01)
*E04F 10/10* (2006.01)
(Continued)

(52) U.S. Cl.
CPC ..... *E04B 7/163* (2013.01); *E04B 1/343* (2013.01); *E04B 1/40* (2013.01); *E04F 10/10* (2013.01)

(58) Field of Classification Search
CPC ..... H02S 20/23; H02S 20/24; H02S 20/26; H02S 20/30; H02S 20/32; E04B 7/163; E04B 1/343; E04B 1/40; E04F 10/10
See application file for complete search history.

(56) References Cited

U.S. PATENT DOCUMENTS 4,128,307 A 12/1978 Badertscher et al.
4,739,816 A * 4/1988 Dodich ..... A01G 9/222 160/168.1 R
(Continued)

FOREIGN PATENT DOCUMENTS

BE 1 019 571 A5 8/2012
CA 2155542 C * 1/2004 ..... E04B 7/163
(Continued)

OTHER PUBLICATIONS

International Search Report dated May 8, 2017.

*Primary Examiner* — Babajide A Demuren
(74) *Attorney, Agent, or Firm* — Symbus Law Group, LLC; Clifford D. Hyra

(57) ABSTRACT

A slat roof (1) comprising beams (2), several slats (3) arranged parallel to one another therebetween and slat shafts (4) by means of which these slats (3) are rotatably fastened to the beams (2), wherein the slat shaft (4) of at least one slat (3) is provided, on at least one end by means of which it is attached to said beam (2), with at least one radial projection (5) and the respective beam (2) comprises a fitting opening (8) with a shaft opening (6) through which the slat shaft (4) extends and an insertion opening (7) which ends in the shaft opening (6) in such a manner that the slat shaft (4), in a first position with the radial projection (5) at the location of the
(Continued)

insertion opening (7), can be fitted through the fitting opening (8) by its end and, in a different position, the radial projection (5) engages behind a part (9) of the beam (2) which delimits the shaft opening (6) adjacent to the insertion opening (7). In addition, a method for adapting a slat roof to form a slat roof (1) as described.

15 Claims, 4 Drawing Sheets

(51) Int. Cl.
*E04B 1/343* (2006.01)
*E04B 1/41* (2006.01)

(56) References Cited

U.S. PATENT DOCUMENTS

| | | | | | |
|---|---|---|---|---|---|
| 6,131,782 | A * | 10/2000 | De Silva | B60R 9/045 | 224/315 |
| 9,145,732 | B2 * | 9/2015 | Frigerio | E04F 10/10 | |
| 2014/0175240 | A1 * | 6/2014 | Selzer | E04B 7/163 | 248/237 |

FOREIGN PATENT DOCUMENTS

| | | | | |
|---|---|---|---|---|
| EP | 0249919 | A2 * | 12/1987 | E04B 7/163 |
| EP | 2803778 | A2 * | 11/2014 | E04B 7/163 |
| WO | WO-2014170920 | A1 * | 10/2014 | E04B 7/163 |

* cited by examiner

SLAT ROOF AND METHOD FOR ADAPTING A SLAT ROOF

This application claims the benefit of Belgian patent application No. 2016/5365, filed May 19, 2016, which is hereby incorporated by reference in its entirety.

FIELD OF THE INVENTION

Embodiments of the present invention relate to a slat roof comprising beams, several slats arranged parallel to one another therebetween and slat shafts by means of which the slats are rotatably fixed to the respective beams.

Embodiments of the present invention furthermore relate to a method for adapting a slat roof to form a slat roof according to embodiments of the present invention.

BACKGROUND

Slat roofs having rotatable slats are usually used to cover an outdoor area, such as a terrace covering or veranda roof, etc. In addition to said slats, a slat roof of this type may also comprise one or more additional slats, such as for example a few fixedly arranged slats. Using such a rotatably arranged slat shaft, the slats are rotatable between an open position, in which an intermediate space extends between the slats, and a closed position, in which the slats together form a closed shelter. By rotating the slats between these positions, it is possible to regulate the incidence of light, radiant heat and ventilation into the space underneath the slats. By directing the slats, it is possible to protect against the sun and/or wind or, on the contrary, to let them in.

In addition, the slats may optionally be provided slideably in the slat roof, with, in that case, the slats being typically slideable between a position in which they are spread out over the slat roof and a position in which they are substantially arranged at one side of the slat roof.

A problem with such slat roofs is that the beams begin to bulge (and bend outwards) under the weight and the bending of the slats suspended between them in the plane of these slats. Wind loads can also cause this phenomenon. On the one hand, this problem is becoming more widespread due to the growing trend of designing larger uninterrupted covers to have such slat roofs and of using heavier slats in such covers, such as glass slats, for example. On the other hand, this problem is also becoming more widespread due to another trend, namely to make these slat roofs simpler, so that they can also be installed by DIY enthusiasts.

In order to remedy this problem, the beams are often designed to be sturdier. However, this requires more material and means that the beams become a great deal more expensive, which also results in a considerable increase in the cost of the entire slat roof. Wider and heavier beams are often also undesirable for aesthetic reasons.

Beams may be placed at an incline (concave), counter to the bulging, so that they return to being straight as a result of the bulging. However, it is difficult to connect such beams neatly to other girders which in this case together form a frame for the slat roof. Such beams are difficult to mitre in an aesthetic manner.

A transverse girder may be provided in the centre of such a slat roof. However, most customers do not wish for such a division of their slat roof using such a transverse girder.

Recently, the present applicant devised a further solution using a tension cable which is fitted inside a hollow slat shaft. This solution was proposed in patent application BE 2015/5333. However, this solution using a tension cable in a hollow slat shaft cannot be applied to all slat roofs equally well. This solution is less suitable, for example, for relatively simple slat roofs where the beams are made in a single piece and, as a consequence, the ends of these tension cables cannot so easily be concealed in said beams.

Another possibility is to fit a circlip to the end of the slat shaft which is fitted through the beam and extends on the other side of the beam from that of the slat. However, this end is usually no longer accessible after the slat has been installed.

SUMMARY

An object of embodiments of the present invention is also to provide an alternative solution to overcome the stated problem.

This object may be achieved by providing a slat roof comprising beams, several slats arranged parallel to one another between these beams and slat shafts by means of which these slats are rotatably fastened to the respective beams, wherein the slat shaft of at least one slat is provided, on at least one end by means of which it is attached to a respective beam, with at least one radial projection and the respective beam comprises at least one fitting opening which comprises a shaft opening through which the corresponding slat shaft extends in the mounted position and comprises an insertion opening which ends in the shaft opening in such a manner that the corresponding slat shaft, in a first position with said radial projection at the location of the insertion opening, can be fitted through the fitting opening by its corresponding end and, after this slat shaft has been inserted in the insertion opening, in a different position, different from the first position, said radial projection engages behind a part of the beam which delimits the shaft opening adjacent to the insertion opening, in order to rotatably attach this slat shaft to this beam.

By allowing one or more such radial projections to engage behind a part of the beam which delimits the shaft opening, one or more slats can be secured with respect to the beams by means of their slat shafts, so that these one or more slats help to keep the beams in position and prevent bending.

Such a radial projection may form an integral part of the slat shaft or may be attached thereto.

A slat of such a slat roof may be rotatably attached to the beams by one single slat shaft, in which case this slat shaft extend along the length of this slat and is rotatably mounted in the beams at its ends. If the last-mentioned slat of a slat roof according to embodiments of the invention comprises such a single slat shaft, then each of the ends of this slat shaft is preferably provided with such a radial projection. Each of the beams is then preferably provided with a said corresponding fitting opening.

However, such a slat may also be provided with a slat shaft at each of its ends, in which case these slat shafts are rotatably mounted in the beams at their opposite end. This is typically the case when the slat shafts are arranged horizontally for the purpose of rotation for the sake of simplicity, while the slat is placed at an angle for the sake of drainage. If the last-mentioned slat of a slat roof according to embodiments of the invention comprises two such slat shafts, then each of these slat shafts is preferably provided with such a radial projection. Each of the beams is then preferably provided with a said corresponding fitting opening.

In a preferred embodiment, said corresponding slat shaft of a slat roof according to embodiments of the present invention is rotatable about its shaft, in order to take it from the first position to the other position.

More specifically, the fitting opening may to this end be substantially configured as a keyhole opening.

A said keyhole opening can be provided in the beam, for example, by means of milling. However, this requires the beam to undergo a milling operation.

Alternatively and more preferably, the fitting opening may for example also be formed by a borehole in the corresponding beam and a substantially C-shaped flexible insertion element which is arranged in this borehole, with the substantially C-shaped flexible insertion element forming said part of the beam that delimits the shaft opening. In this case, a simple borehole in the beam is then sufficient, in which case only a flexible insertion element which has already been produced has to be provided in the beam.

In the case of keyhole openings which are produced in the beam by means of milling, such a flexible insertion element would still have to be provided in the beam, thus necessitating an additional operation. However, the advantage of such a milled keyhole opening is that the insertion opening can have larger dimensions. The corresponding radial projection may then have larger dimensions, so that this radial projection could in principle also engage behind the edge of the shaft opening across a larger zone in order to secure the slat with respect to the beam.

In order to provide said substantially C-shaped flexible insertion element in the borehole, the former may be pressed to form a shape which is smaller than the said borehole and can be inserted freely herein. Subsequently, this substantially C-shaped flexible insertion element may be released again in order to flexibly expand again until it is pressed against the edges of the borehole and forms a C-shaped edge that delimits the shaft opening. The cavity inside the C shape itself in this case forms the shaft opening. The opening between the legs of the C shape then forms the insertion opening of the fitting opening.

Preferably, each position of the said corresponding slat shaft of a slat roof according to embodiments of the present invention, in which this slat shaft is rotatable in the mounted position of the slat roof, may be a said different position. In this way, the slat shaft always remains secured in the fitting opening during normal operation of the slat roof, so that the bending of the beams does not vary too greatly upon rotation of the slats in the mounted position of the slat roof. Therefore, this slat shaft cannot accidentally become detached from the beam.

A slat roof according to embodiments of the present invention furthermore preferably also comprises at least one spacer which is arranged between the said at least one slat and a corresponding beam. Such a spacer may help to ensure in a simple manner that the radial projection engages behind the said edge.

More specifically, such a spacer may be configured as a sleeve with a substantially C-shaped cross section which is arranged around the corresponding slat shaft.

In a preferred slat roof according to embodiments of the present invention, the slat shafts of several slats comprise said radial projections and the corresponding ends may be fitted in said fitting openings of the beams. By thus securing several slats with respect to the beams by means of their slat shafts, it is possible to ensure with even greater certainty that the beams are held in position and bending is prevented.

Still more preferably, the slat shafts of all slats therefore comprise said radial projections and the corresponding ends are fitted in said fitting openings of the beams.

The beams of the slat roof according to embodiments of the present invention are preferably hollow, so that the ends of the slat shafts can end in said cavity.

Preferably, the slat shaft of at least one slat of a slat roof according to embodiments of the present invention may furthermore be provided, at a certain at least one end by means of which it is attached to a said beam, with at least one radial projection which, in the mounted position, extends between the slat and the respective beam, against this beam. In this case, this radial projection then forms a securement against the beams becoming concave.

Still more preferably, the slat shafts of several slats may comprise such radial projections and most preferably the slat shafts of all slats may comprise such radial projections.

In addition, an object of the present application is also achieved by providing a method for adapting a slat roof comprising beams, several slats arranged parallel to one another between these beams and slat shafts by means of which the slats are rotatably fixed to the respective beams, in which case the slat shaft of at least one slat is provided, on at least one end, with at least one radial projection, in which the respective beam is provided with a corresponding fitting opening which comprises a shaft opening through which the corresponding slat shaft extends in the mounted position and comprises an insertion opening which ends in the shaft opening, in which the corresponding slat shaft, in a first position with said radial projection at the location of the insertion opening, is fitted through the fitting opening by its corresponding end and in which, after it has been inserted in the insertion opening, it is moved to a different position, different from the first position, in which it engages, by means of the said radial projection, behind a part of the beam which delimits the shaft opening adjacent to the insertion opening, in order to attach this slat shaft to the beam.

In a preferred method according to embodiments of the present invention, a spacer is fitted between the slat and the beam after the corresponding slat shaft has been installed in the fitting opening and moved to the other position. More specifically, to this end, a sleeve with a substantially C-shaped cross section can be fitted over the slat shaft in order to fit it as a spacer between the slat and the beam.

BRIEF DESCRIPTION OF THE DRAWINGS

Embodiments of the present invention will now be explained in more detail by means of the following detailed description of single preferred embodiments of a slat roof according to embodiments of the present invention. The sole aim of this description is to give illustrative examples and to indicate further advantages and particulars of embodiments of the present invention and can therefore not be interpreted as a limitation of the area of application of the invention or of the patent rights defined in the claims.

Reference numerals are used in this detailed description to refer to the attached drawings, in which.

DETAILED DESCRIPTION OF EMBODIMENTS

Figure 1:
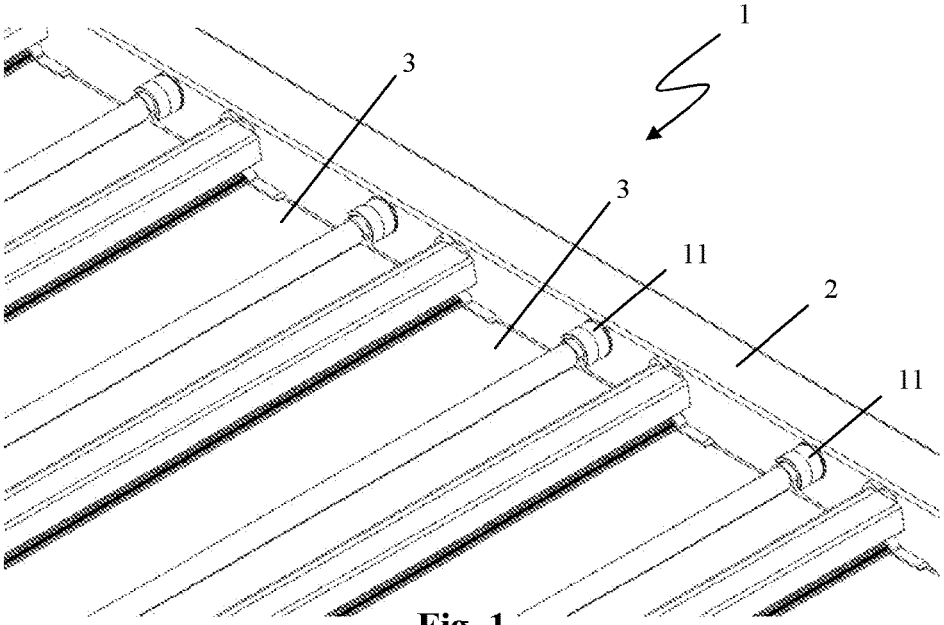
FIG. 1 shows a part of a slat roof according to the present invention in perspective at the location of a beam and several slats attached thereto.

The slat roof (1) illustrated in FIG. 1 comprises several slats (3) which are arranged parallel to each other between two beams (2), only one beam (2) of which has been illustrated in the figures. The other beam (2) is of similar construction to the illustrated beam (2). These slats (3) are attached to the beams (2) so as to be rotatable by means of slat shafts (4), which are shown in the further figures.

The slats (3) can be moved between an open position and a closed position by rotating them. In the open position, there is an intermediate space between the slats (3), through which, for example, air can enter the space situated underneath or can leave this space situated underneath. In the closed position, the slats (3) form a closed shelter which can protect the space situated underneath against, for example, wind and/or precipitation.

With respect to drainage of precipitation, the slats (3) are arranged such that they slope towards one of the two beams (2).

The beams (2) may be made of, for example, aluminium, plastic, wood, etc. In the illustrated embodiment, these beams (2) are hollow.

The slats (3) may, for example, also be made from profiled sections of aluminium or plastic and may, if desired, be provided with filler elements made of, for example, polycarbonate, glass, wood, etc.

Figure 9:
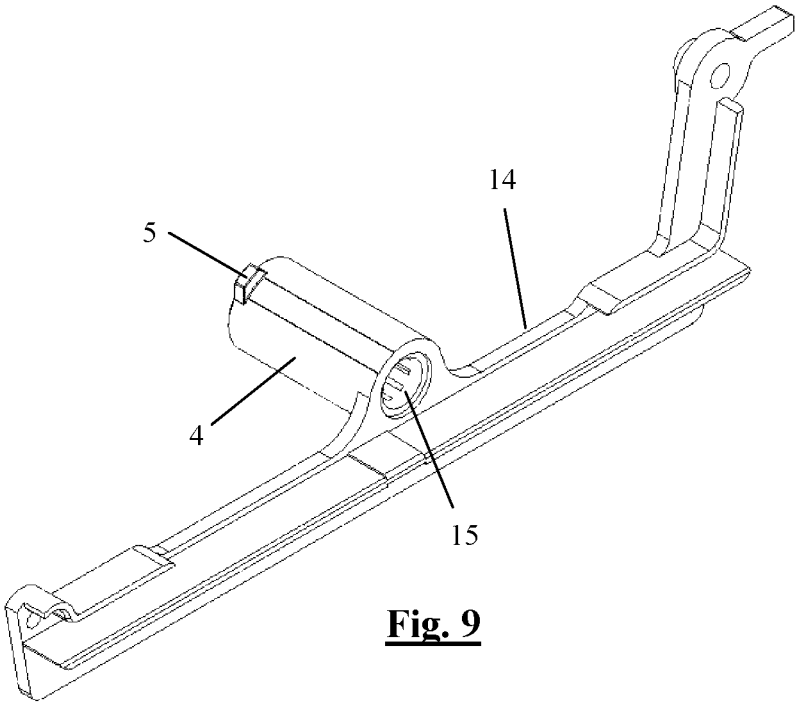
FIG. 9 shows a perspective view of an end piece of a slat from the slat roof from FIG. 1 separately.

A shaft is fitted through each slat (3) of the illustrated slat roof (1), which shaft is not visible in the figures. To each end of each slat (3), an end piece (14) is fitted which is illustrated separately in FIG. 9. The said shaft of the slat (3) is in this case fitted in the cavity (15) of this end piece (14). To this end piece (14), a slat shaft (4) is fitted which is provided at its end with a radial projection (5). Such an end piece (14) may be made, for example, from plastic.

Figure 5:
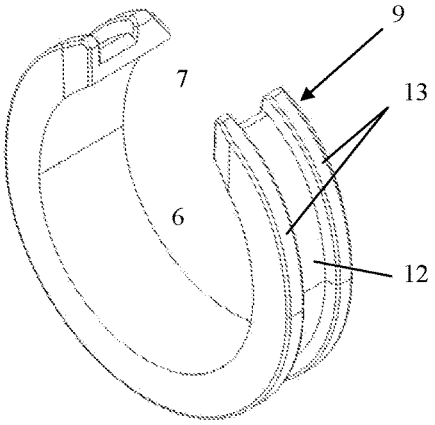
FIG. 5 shows a perspective view of a substantially C-shaped insertion element from the slat roof from FIG. 1 separately.

In order to be able to fit the slats (3) to the beams (2) so as to be rotatable, boreholes (10) are provided in a side wall of each beam (2) which form openings to the interior of this beam (2). In these boreholes (10), substantially C-shaped flexible insertion elements (9) are in each case provided. Such a substantially C-shaped flexible insertion element (9) has been shown separately in a perspective view in FIG. 5. This may be made, for example, from rubber or plastic. On its outer circumference, this insertion element (9) is provided with a groove (12) which is delimited by two ribs (13). By pushing in this insertion element (9), it can be inserted into a said borehole (10). By then releasing this insertion element (9) again thereafter, it will return to its original shape in a flexible way and can be mounted in this borehole (10), with the edge of the borehole (10) engaging in the groove (12) and the ribs (13) extending next to the side wall of the beam (2). In this way, this substantially C-shaped flexible insertion element (9) forms a C-shaped edge which delimits a shaft opening (6), through which, in the mounted position of the slat roof (1), a slat shaft (4) may engage. The opening (7) between the legs of the C shape forms an insertion opening (7) through which the radial projection (5) of a slat shaft (4) may be fitted. The shaft opening (6) and the insertion opening (7) together form a keyhole-shaped fitting opening (8) for mounting a slat shaft (4).

Figure 2:
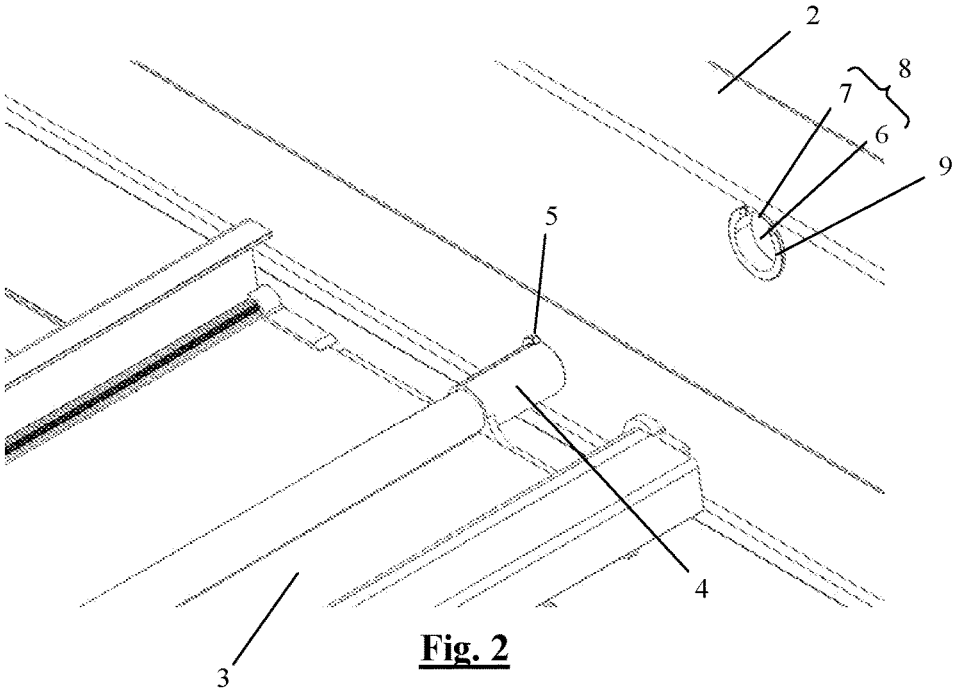
FIGS. 2-4 show a perspective view of the various steps involved in fitting a slat to the beam from the slat roof in FIG. 1.
Figure 3:
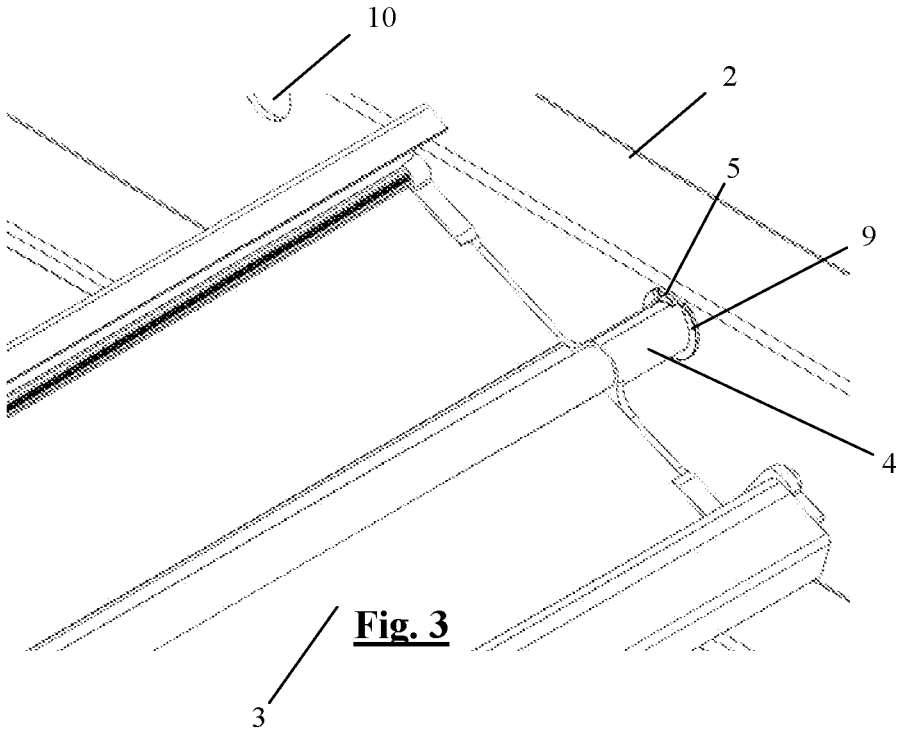
Figure 4:
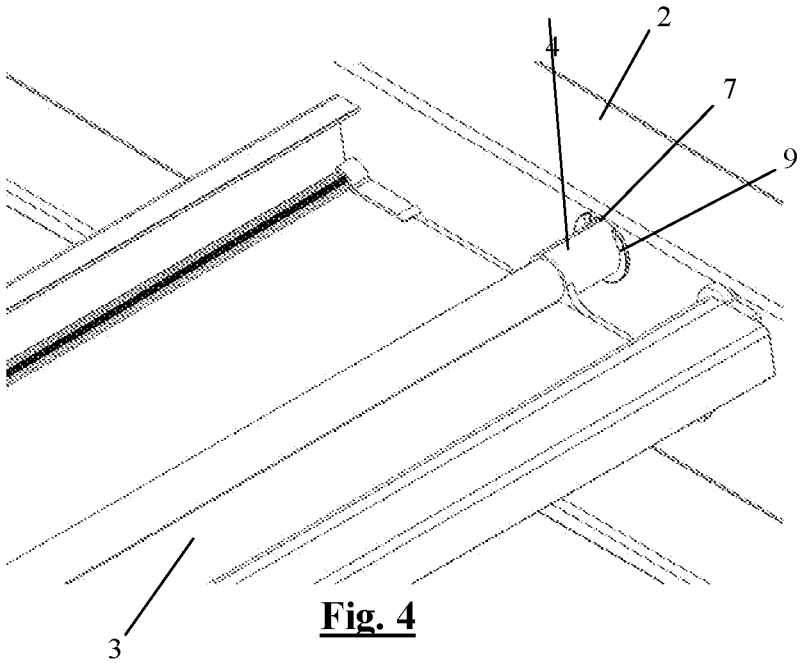
Figure 6:
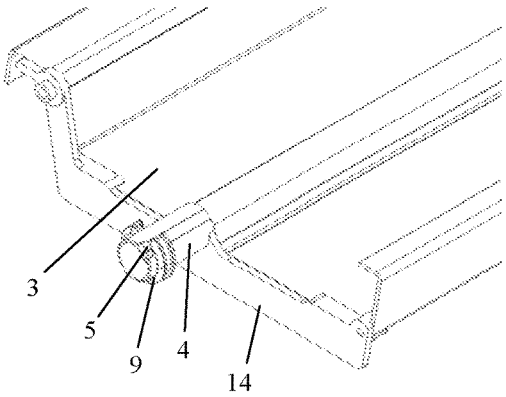
FIGS. 6-8 show a perspective view of a slat with a substantially C-shaped insertion element from the slat roof from FIG. 1, with the slat in different rotational positions.
Figure 7:
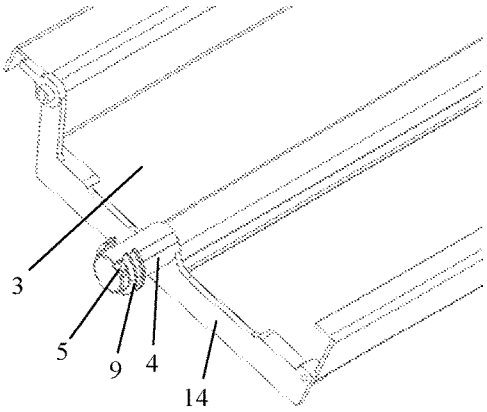
Figure 8:
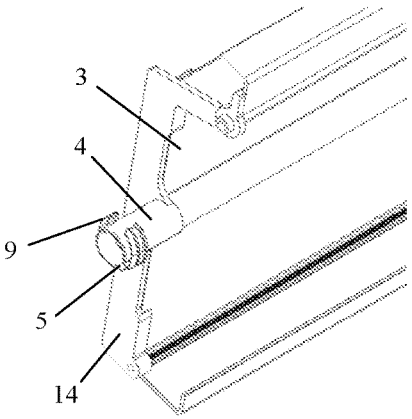

FIGS. 2 to 4 show how a slat (3) can be mounted in such a fitting opening (8) by means of its slat shaft (4). In a first position of the slat shaft (4), as illustrated in FIG. 2, in which the radial projection (5) is situated at the location of the insertion opening (7), the slat shaft (4) can be fitted through the fitting opening (8), as is illustrated in FIG. 3. The radial projection (5) at the end of the slat shaft (4) then extends into the cavity of the beam (2). In this case, the slat shaft (4) is first brought so far into the cavity that it is possible to fit the corresponding slat shaft (4) at the other end of the slat (3) in a corresponding fitting opening (8) of the other beam (2) in a similar manner. Subsequently, the slat (3) will extend between both beams (2), with the radial projections (5) at the ends of the corresponding slat shafts (4) being situated in the cavities of the beams (2). Thereafter, the slat shaft (4) can be rotated in such a manner that each radial projection (5) engages behind the corresponding C-shaped flexible insertion element (9). In order to prevent the slat shafts (4) from being released again from the corresponding fitting openings (8), sleeves (11) with a C-shaped cross section are fitted over the slat shafts (4) as spacers (11), between the slat (3) and the beams (2), as can be seen in FIG. 1. In addition, the position of the C-shaped flexible insertion element (9) is chosen such that the first position is a position into which the slat (3) can only be moved during fitting or removal of the slat roof (1). In the mounted position of the slat roof (1), the slat (3) can no longer be moved into this position, due to the presence of the other slats (3), as can be seen in FIG. 1. In the rotation positions, into which the slat (3) can be moved in the mounted position of the slat roof (1), the radial projection (5) will always engage behind the C-shaped flexible insertion element (9), as can be seen in FIGS. 6 to 8.

The invention claimed is:

1. Slat roof, comprising beams;

several slats arranged parallel to one another between these beams;

slat shafts by means of which these slats are rotatably fastened to the respective beams;

wherein the slat shaft of at least one slat is provided, on at least one end by means of which it is attached to said beam, with at least one radial projection, and the respective beam comprises at least one fitting opening which comprises a shaft opening through which the corresponding slat shaft extends in a mounted position and comprises an insertion opening which ends in the shaft opening in such a manner that the corresponding slat shaft, in a first position with said radial projection at the location of the insertion opening, can be fitted through the fitting opening by its corresponding end and, after this slat shaft has been inserted into the insertion opening, in a different position from the first position, said radial projection engages behind a part of the beam which delimits the shaft opening adjacent to the insertion opening, in order to rotatably attach this slat shaft to this beam.

2. Slat roof according to claim 1, characterized in that the said corresponding slat shaft is rotatable from the first position to the other position.

3. Slat roof according to claim 2, characterized in that the fitting opening is substantially configured as a keyhole opening.

4. Slat roof according to claim 3, characterized in that the fitting opening is formed by a borehole in the corresponding beam and a substantially C-shaped flexible insertion element which is arranged in this borehole, with the substantially C-shaped flexible insertion element forming said part that delimits the shaft opening.

5. Slat roof according to claim 1, characterized in that each position of the said corresponding slat shaft in which it is rotatable in the mounted position of the slat roof is a said different position.

6. Slat roof according to claim 1, characterized in that the slat roof comprises at least one spacer which is arranged between the said at least one slat and a corresponding beam.

7. Slat roof according to claim 6, characterized in that the spacer is configured as a sleeve with a substantially C-shaped cross section which is arranged around the corresponding slat shaft.

8. Slat roof according to claim 1, characterized in that each end of the slat shaft or slat shafts of the said at least one slat, by means of which it is attached to a respective beam, is provided with at least one said radial projection and is arranged in said corresponding fitting opening of the respective beam.

9. Slat roof according to claim 1, characterized in that the slat shafts of several slats comprise said radial projections and the corresponding ends are fitted in said fitting openings of the beams.

10. Slat roof according to claim 9, characterized in that the slat shafts of all slats comprise said radial projections and the corresponding ends are fitted in said fitting openings of the beams.

11. Slat roof according to claim 1, characterized in that the beams are hollow.

12. Slat roof according to claim 1, characterized in that the slat shaft of at least one slat is provided, at a certain at least one end by means of which it is attached to said beam, with at least one radial projection which, in the mounted position, extends between the slat and the respective beam against this beam.

13. Method for adapting a slat roof comprising beams, several slats arranged parallel to one another between these beams and slat shafts by means of which the slats are rotatably fixed to the respective beams, comprising providing the slat shaft of at least one slat, on at least one end, with at least one radial projection, providing the respective beam with a corresponding fitting opening which comprises a shaft opening through which the corresponding slat shaft extends in the mounted position and comprises an insertion opening which ends in the shaft opening in such a manner that the corresponding slat shaft, in a first position with said radial projection at the location of the insertion opening, is fitted through the fitting opening by its corresponding end, and, after it has been inserted in the insertion opening, moving the slat shaft to a different position from the first position, in which the slat shaft engages by means of said radial projection behind a part of the beam which delimits the shaft opening adjacent to the insertion opening, in order to attach this slat shaft to the beam.

14. Method according to claim 13, further comprising fitting a spacer between the slat and the beam after the corresponding slat shaft has been installed in the fitting opening and moved to the other position.

15. Method according to claim 14, further comprising fitting a sleeve with a substantially C-shaped cross section over the slat shaft in order to fit the sleeve as a spacer between the slat and the beam.

* * * * *